United States Patent [19]

Geberth, Jr.

[11] 4,220,286

[45] Sep. 2, 1980

[54] ADJUSTABLE SPRAY TIP

[76] Inventor: John D. Geberth, Jr., Rifle Camp Rd., West Paterson, N.J. 07424

[21] Appl. No.: 879,263

[22] Filed: Feb. 21, 1978

[51] Int. Cl.[2] ..... B05B 1/32

[52] U.S. Cl. ..... 239/455; 239/586

[58] Field of Search ..... 239/455, 586, 597; 251/368, 357

[56] References Cited

U.S. PATENT DOCUMENTS

| | | | |
|---|---|---|---|
| 816,470 | 3/1906 | Higgins | 239/455 |
| 1,964,687 | 6/1934 | May | 251/368 |
| 2,988,321 | 6/1961 | Gilmont | 251/368 X |
| 3,184,259 | 5/1965 | Almdale | 251/368 X |
| 3,936,002 | 2/1976 | Geberth, Jr. | 239/455 |
| 4,073,474 | 2/1978 | Hashimoto et al. | 251/368 |
| 4,126,272 | 11/1978 | Geberth, Jr. | 239/455 |

*Primary Examiner*—Robert B. Reeves
*Assistant Examiner*—Gene A. Church
*Attorney, Agent, or Firm*—Joseph J. Orlando

[57] ABSTRACT

An improved adjustable spray tip or nozzle is provided for spray guns and like devices which are adapted to hydraulically atomize and spray liquids such as paint. The spray tip includes an adjustable valve stem which varies, by means of adjustable movement, the spray opening and thus the fan spray issuing from the spray tip. The improvement includes providing a valve stem which is fracture resistant as well as erosion resistant.

9 Claims, 2 Drawing Figures

ADJUSTABLE SPRAY TIP

Figure 1:
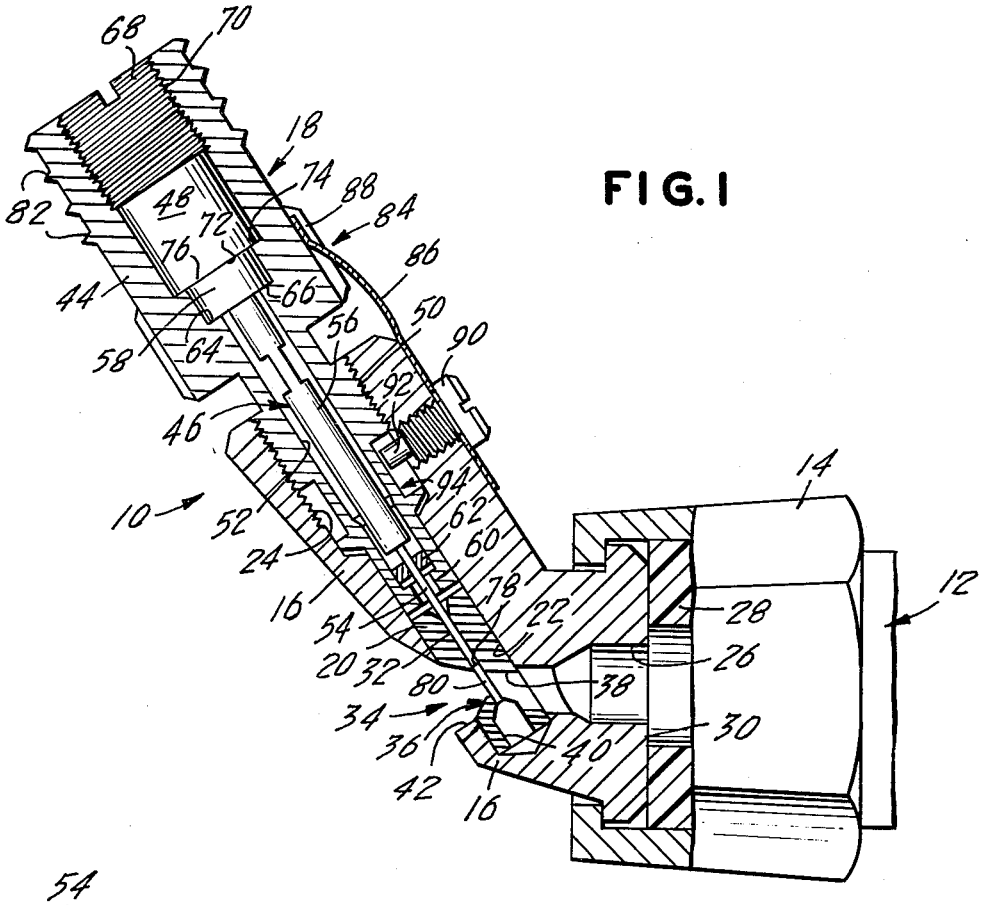

The present invention relates generally to spray tips or nozzles for use with spray guns and like devices which hydraulically atomize and spray liquids such as paint and, more particularly, it relates to an improvement in an adjustable spray nozzle for use with such spray guns.

In my earlier filed application, now U.S. Pat. No. 3,936,002, granted Feb. 3, 1976, there is disclosed an adjustable spray tip or nozzle for use with spray guns which hydraulically atomize and spray liquids such as paint. As disclosed therein, the spray nozzle body is mounted to the spray gun in communication with a fluid passageway extending through the spray gun. Included in the spray nozzle body are a valve bore extending partially therethrough, a groove is formed in the spray nozzle body intersecting the valve bore which thereby forms a spray or nozzle opening, and a fluid bore in the spray nozzle body which provides communication between the valve bore and the fluid passageway of the spray gun. The pressurized liquid is thus transferred through the spray gun to the valve bore to be exited through the nozzle opening. For the purpose of adjusting the fan spray issuing from the nozzle opening there is provided a valve stem which is moveable in the valve bore by means of an external adjustment knob to thereby vary the nozzle opening and in turn the fan spray issuing therefrom. In another earlier filed application, U.S. Ser. No. 659,755, filed Feb. 20, 1976, I have disclosed certain improvements to the above-described adjustable spray nozzle which are unconnected to the improvement herein disclosed. The present invention, more particularly described hereinafter, is concerned with a further improvement to the basic invention and is useful and advantageous in the operation of the adjustable spray nozzle described above.

It has long been known that since the pressure and velocity of the liquid passing through the nozzle opening of a hydraulically operated spray gun is very great, the parts of the spray nozzle exposed to such liquid are subject to very high erosion forces. Thus, it was found necessary to form such parts of a material of suitable high erosion resistance. One such material which has been utilized with much success is tungsten carbide. Unfortunately, tungsten carbide and other suitable materials are very brittle and easily broken or cracked. This problem is greatly amplified in my adjustable spray nozzle wherein the adjustable valve stem is one of those parts which is exposed to the highly erosive forces and thus ideally formed of tungsten carbide. By its very nature of being long and slender and unsupported through a good part of its length, the valve stem is delicate and, when formed of a brittle material, highly susceptible to being broken. In fact, it has been found that breaking of the valve stem, resulting from the sudden shock of an impact, as when the spray nozzle or spray gun is inadvertently dropped by the operator, is a common problem. Another related problem concerns the use of paint which may collect about the valve stem and harden during periods of non-use. The valve stem is then placed in tension when the operator desires to increase the nozzle opening, oftentimes resulting in the brittle valve stem fracturing.

It is, therefore, a primary object of the present invention to provide an improved adjustable spray nozzle for use in hydraulically atomizing and spraying liquids wherein the propensity for breaking or fracturing of the valve stem as described above and the resulting inoperability of the spray tip or nozzle is significantly diminished or eliminated.

This object, as well as others which will hereinafter become apparent, is accomplished in accordance with the present invention by providing a valve stem as described above formed of a tough material, such as steel, and having a hard, erosion-resistant material bonded to the end of the valve stem. It is only the end of the valve stem which is exposed to the highly erosive forces of the fluid passing through the spray nozzle and therefore only that portion which must be formed of the hard, erosion-resistant material. The remainder of the valve stem, being formed of a tough material rather than the hard, brittle material, greatly diminishes or eliminates the likelihood of the valve stem fracturing as the result of a sudden impact or the application of a tensile force to the valve stem.

Figure 2:
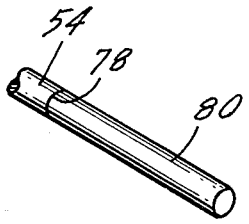

The present invention will be described and understood more readily when considered together with the embodiment shown in the accompanying drawings, in which:

FIG. 1 is an enlarged cross-sectional view of the spray nozzle according to the present invention; and FIG. 2 is a greatly enlarged portion of the valve stem in the spray nozzle of FIG. 1.

Referring now to the drawings, there is shown in FIG. 1 a cross-sectional view of a spray nozzle, generally designated 10, attached to a spray device, such as a spray gun, a portion only of which is shown at 12, by means of retaining nut 14. Spray nozzle 10 includes a spray nozzle housing, generally designated 16, a valve adjustment assembly, generally designated 18, and a valve housing, generally designated 20. Spray nozzle housing 16 is provided with a bore, generally designated 22, adapted to accept valve housing 20 which may be press fitted therein. Coaxially aligned and communicating with bore 22 is a threaded bore, generally designated 24, which is adapted to accept valve adjustment assembly 18. Nozzle housing 16 is also provided with a fluid bore 26 which, at its upstream end, communicates with the bore (not shown) passing through spray device 12 which in turn communicates with a reservoir (not shown) of fluid under high pressure. At its downstream end, fluid bore 26 intersects bore 22 of nozzle housing 16. A gasket, generally designated 28, is provided between the face 30 of spray nozzle housing 16 and the spray device 12 so that upon the tightening of retaining nut 14 leakage of the fluid transferred to spray nozzle 10 is prevented.

Valve housing 20, which, because of the passage therethrough of the liquid under high pressure and great velocity, must be formed of a hard, erosion-resistant material, is provided with a centrally located longitudinal valve bore, generally designated 32. Although the material preferred for such use, because of its high erosion resistance, is tungsten carbide, other suitable materials, such as ceramic, sapphire, etc., may be utilized with equal success. A spray opening, designated 34, is formed in housing 20 by means of groove 36 which is cut or otherwise formed in housing 20 and which intersects valve bore 32. Opposite to and aligned with spray opening 34 is a slotted bore, generally designated 38, which is formed in valve housing 20 and which also intersects valve bore 32. Below spray opening 34, valve bore 32 is provided with a dilated or expanded portion, designated 40, the purpose of which is to permit the operator, by means of a sharp instrument, to dislodge particles or broken pieces which may become lodged in that portion of bore 32. Slotted bore 38 is so dimensioned as to encompass all of spray opening 34 as well as a part of expanded portion 40 of valve bore 32. Valve housing 20 is press fitted within bore 22 of housing 16 so that slotted bore 38 thereof is aligned with fluid bore 26 of housing 16 thereby providing a continuous passageway for the fluid held under high pressure in the reservoir to spray opening 34. Spray nozzle housing 16 is also provided with an opening, generally designated 42, which is aligned with spray opening 34 to thereby permit the discharge of the fluid in the form of a fan spray from spray nozzle 10.

Valve adjustment assembly 18 comprises assembly housing 44, valve stem assembly 46 and valve stem assembly retainer 48. Assembly housing 44 is provided with a male threaded portion 50 which is mateable with the female threaded bore 24 of spray nozzle housing 16 thereby permitting threadable engagement and adjustment of valve adjustment assembly 18 with respect to housing 16. A bore, generally designated 52, is centrally located in assembly housing 44 and is adapted to accept valve stem assembly 46 which is retained in bore 52 by means of valve stem assembly retainer 48.

Valve stem assembly 46 includes a valve stem, designated 54, a shank portion, designated 56, and a retaining head, designated 58. Valve stem 54 is connected at one end to shank 56 by any suitable means such as being pressed in, welded, etc., and at its other end passes through restricted opening 60 at the base of assembly housing 44 and well into valve bore 32 of valve housing 20. A resilient washer, designated 62, in bore 52 serves as a seal to prevent fluid, such as paint, from entering bore 52, hardening and thereby interfering with or causing damage to valve stem assembly 46. In order to limit the movement of valve stem assembly 46 in a downward direction within bore 52, retaining head 58 is provided with a shoulder, designated 64, which abuts a complementary shoulder, designated 66, in bore 52 of assembly housing 44. In order to retain valve stem assembly 46 within bore 52, valve stem assembly retainer 48 is provided with a male threaded portion, designated 68, which is mateable with a female threaded portion, designated 70, of bore 52 and the base, designated 72, of retainer 48 is designed to abut against shoulder, designated 74, in bore 52 of assembly housing 44. The space thus formed between base 72 of retainer 48 and shoulder 66 in bore 52 allows for a very slight clearance between upper surface 76 of retaining head 58 and base 72 of retainer 48 and between shoulders 64 and 66. The above described arrangement permits valve stem assembly 46 to "float" with respect to assembly housing 44 to thereby insulate the valve stem assembly, to some extent, from shocks which may be transmitted to spray nozzle 10 and to also prevent torque from being applied to valve stem 54 when valve adjustment assembly 18 is screwed in or out of spray nozzle housing 16 during adjustment of spray opening 34.

As clearly seen in FIG. 2, valve stem 54, which is formed of a tough material such as steel, is provided at its free end, designated 78, with a tip portion, designated 80, formed of a hard, erosion-resistant material such as tungsten carbide. Tip portion 80 may be bonded to end 78 of valve stem 54 by any suitable means such as brazing, welding, flame spraying, epoxy, etc. Tip portion 80 of valve stem 54 is provided for the purpose of resisting the erosive effects of the sprayed fluid, such as paint, which impinges upon valve stem 54 in its passage to spray opening 34. Valve stem 54, as noted above, is formed of a tough material for the purpose of limiting or eliminating the possibility of the valve stem fracturing or breaking. It has been found that in order to prevent such fracturing of the valve stem the length of tip portion 80 should be no greater than five times the diameter of the valve stem and preferably no greater than three times such diameter. It also has been found that in order to provide sufficient resistance to erosion, the length of tip portion 80 should be no less than one half the diameter of the valve stem. In any case, the length of tip portion 80 should be sufficient to cover the spray opening 34 in its closed position so that no part of the less erosion-resistant material of valve stem 54 is exposed to the fluid.

In order to adjust the positioning of valve stem 54 within bore 32 of housing 20 and thus the extent of the opening of spray opening 34, valve adjustment assembly 18 is screwed in or out of spray nozzle housing 16 by the operator gripping and turning knurled portion 82 of adjustment assembly 18. A ratchet mechanism, designated 84, which may comprise a spring clip 86 engageable with grooved portion 88 of valve adjustment assembly 18, serves to prevent the inadvertent or accidental adjustment or movement of valve stem 54. Spring clip 86 may be secured to spray nozzle housing 16 by means of screw 90. In order to prevent valve adjustment assembly 18 from being inadvertently withdrawn from spray nozzle housing 16, a stem, designated 92, may be provided on the end of screw 90 which extends into bore 22 to cooperate with channel 94 in assembly housing 44 to thus limit the coaxial movement of assembly housing 44.

It is to be understood that the foregoing general and detailed descriptions are explanatory of the present invention and are not to be interpreted as restrictive of the scope of the following claims.

What is claimed is:

1. An adjustable spray nozzle for use with a spray device adapted for hydraulically atomizing and spraying liquids, the spray device having conduit means communicating with a source of liquid under pressure, said adjustable spray nozzle including:

(a) a spray nozzle housing including means for securing said housing to said spray device;

(b) a fluid bore in said housing communicating with said conduit means and terminating in a spray opening in said housing;

(c) A valve bore in said housing intersecting said fluid bore adjacent said spray opening;

(d) a valve stem adapted for adjustable movement in said valve bore to vary the size of said spray opening, said valve stem being formed of a tough material having bonded to the end thereof a hard, erosion-resistant material; and (e) means for adjustably moving said valve stem in said valve bore externally of said spray nozzle housing.

2. The adjustable spray nozzle of claim 1 wherein the tough material of which the valve stem is formed is steel.

3. The adjustable spray nozzle of claim 1 wherein the hard, erosion-resistant material bonded to the end of said valve stem is tungsten carbide.

4. The adjustable spray nozzle of claim 1 wherein the hard, erosion-resistant material bonded to the end of said valve stem is a ceramic material.

5. The adjustable spray nozzle of claim 1 wherein the hard, erosion-resistant material bonded to the end of said valve stem is sapphire.

6. The adjustable spray nozzle of claim 1 wherein said valve stem floats with respect to said spray nozzle housing.

7. The adjustable spray nozzle of claim 1 wherein the length of said hard, erosion-resistant material is between one-half and five times the diameter of said valve stem.

8. The adjustable spray nozzle of claim 1 wherein the length of said hard, erosion-resistant material is between one-half and three times the diameter of said valve stem.

9. The adjustable spray nozzle of claim 1 wherein the length of said hard, erosion-resistant material is as great as the spray opening in said spray nozzle housing.

* * * * *